US005983984A

United States Patent [19]

Auderheide et al.

[11] Patent Number: 5,983,984

[45] Date of Patent: Nov. 16, 1999

[54] INSULATING SLEEVE COMPOSITIONS AND THEIR USES

[75] Inventors: Ronald C. Auderheide; Helena Twardowska, both of Dublin; Ralph E. Showman, Hilliard, all of Ohio

[73] Assignee: Ashland Inc., Dublin, Ohio

[21] Appl. No.: 09/005,769

[22] Filed: Jan. 12, 1998

[51] Int. Cl.[6] ..... B22C 1/16; B22C 9/08

[52] U.S. Cl. ..... 164/527; 164/359; 164/529; 501/80; 501/128

[58] Field of Search ..... 164/359, 360, 164/527, 529; 501/80, 128

[56] References Cited

U.S. PATENT DOCUMENTS

| | | | |
|---|---|---|---|
| 3,485,797 | 12/1969 | Robins | 526/71 |
| 4,574,869 | 3/1986 | Trinkl et al. | 164/360 |
| 5,632,326 | 5/1997 | Gough | 164/529 |

FOREIGN PATENT DOCUMENTS

| | | |
|---|---|---|
| 922505 | 4/1963 | United Kingdom . |
| 1279096 | 6/1972 | United Kingdom . |
| 1283692 | 8/1972 | United Kingdom . |
| 2001658A | 2/1979 | United Kingdom . |
| 2096928A | 10/1982 | United Kingdom . |
| WO 94/23865 | 10/1994 | WIPO . |

OTHER PUBLICATIONS

A. Konieczny, W. Rakowski, Z. Ignaszak, A. Baranowski, Technology of making insulating sleeves with the use of microspheres for production of iron castings, Przeglad Odlewnictwa, May 1989, pp. 172–176.

*Primary Examiner*—J. Reed Batten, Jr.
*Attorney, Agent, or Firm*—David L. Hedden

[57] ABSTRACT

Insulating sleeve mixes that contain hollow aluminosilicate microspheres, an organic binder, and boric acid and/or a phosphate, and their uses.

11 Claims, No Drawings

INSULATING SLEEVE COMPOSITIONS AND THEIR USES

FIELD OF THE INVENTION

This invention relates to insulating sleeve mixes and their use in preparing sleeves. The sleeve mixes comprise hollow aluminosilicate microspheres, an organic binder, and boric acid and/or a phosphate glass. The invention also relates to sleeves prepared with the sleeve mix, and the uses of the sleeves in a casting assembly to make metal parts.

BACKGROUND OF THE INVENTION

A casting assembly consists of a pouring cup, a gating system (including downsprues, choke, and runner), risers, sleeves, molds, cores, and other components. To produce a metal casting, metal is poured into the pouring cup of the casting assembly and passes through the gating system to the mold and/or core assembly where it cools and solidifies. The metal part is then removed by separating it from the core and/or mold assembly.

Risers or feeders are reservoirs which contain excess molten metal which is needed to compensate for contractions or voids of metal which occur during the casting process. Metal from the riser fills such voids in the casting when metal from the casting contracts. Thus the metal from the riser is allowed to remain in a liquid state for a longer period of time, thereby providing metal to the casting as it cools and solidifies. Sleeves are used to surround or encapsulate the riser and other parts of the casting assembly in order to keep the molten metal in the riser hot and maintain it in the liquid state. The temperature of the molten metal and the amount of time that the metal in the riser remains molten is a function of the sleeve composition and the thickness of the sleeve wall, among other factors.

In order to serve their function, sleeves must have exothermic and/or insulating properties. Exothermic sleeves operate by liberating heat thereby keeping the metal hotter and liquid longer. Insulating sleeves, on the other hand, maintain the molten metal in the riser by insulating it from the surrounding mold assembly.

Although aluminosilicate fibers are traditionally used for making insulating sleeves, recently there is an interest in making insulating sleeves using hollow aluminosilicate microspheres, as the insulating material, and an organic binder. The advantage of using hollow aluminosilicate microspheres is that sleeves can be made with better dimensional accuracy than those made with aluminosilicate fibers. Nevertheless, sleeves made with the hollow aluminosilicate microspheres and an organic binder cannot be reused effectively because the organic binder completely degrades at high temperatures (i.e. greater than 500° C.) which are reached during the metal casting process. Once the bonded organic binder degrades, there is nothing left to hold the hollow aluminosilicate microspheres together and the sleeve falls apart.

SUMMARY OF THE INVENTION

This invention relates to an insulating sleeve mix comprising:

A. a major amount of an insulating refractory material comprising hollow aluminosilicate microspheres;

B. a chemically reactive organic binder in amount of at least 5 weight percent based upon the weight of (A); and C. a hot strength enhancing amount of an inorganic binder selected from the group consisting of boric acid, phosphate glass, and mixtures thereof.

The inorganic binder is activated by the heat of the molten metal during casting and supplies strength to the sleeve by chemically bonding the hollow aluminosilicate microspheres after the organic binder is burned away. Boric acid and phosphate glass are compatible with the organic binder and hollow aluminosilicate microspheres at room temperature and at the temperatures reached when metal is cast.

The invention also relates to insulating sleeves produced with the sleeve mix. Insulating sleeves can be prepared by the hot-box, no-bake, and cold-box processes. It also relates to the casting of ferrous and preferably non ferrous (aluminum) metal parts and to the parts made by this casting process.

DEFINITIONS

The following definitions will be used for terms in the disclosure and claims:

Casting assembly—assembly of casting components such as pouring cup, downsprue, gating system (downsprue, runner, choke), molds, cores, risers, sleeves, etc. which are used to make a metal casting by pouring molten metal into the casting assembly where it flows to the mold assembly and cools to form a metal part.

Cold-box—mold or core making process which utilizes a vaporous catalyst to cure the mold or core.

EXACTCAST™ binder—a two part polyurethane-forming cold-box binder where the Part I is a phenolic resin similar to that described in U.S. Pat. No. 3,485,797. The resin is dissolved in a blend of aromatic, ester, and aliphatic solvents, and a silane. Part II is the polyisocyanate component comprises a polymethylene polyphenyl isocyanate, a solvent blend consisting primarily of aromatic solvents and a minor amount of aliphatic solvents, and a benchlife extender. The weight ratio of Part I to Part II is about 55:45.

EXTENDOSPHERES SG—hollow aluminosilicate microspheres sold by PQ Corporation having a particle size of 10–350 microns and an alumina content between 38% by weight based upon the weight of the microspheres.

EXTENDOSPHERES SLG—hollow aluminosilicate microspheres sold by PQ Corporation having a particle size of 10–300 microns and an alumina content of at least 40% by weight based upon the weight of the microspheres.

Hot-box process—a process for making a core and/or mold which employs an organic binder, but in which the sleeve mix is cured by heat rather than a catalyst.

Insulating sleeve—a sleeve having greater insulating properties than the mold/core assembly into which it is inserted. An insulating sleeve typically contains low density materials such as fibers and/or hollow microspheres.

No-bake—mold or core making process which utilizes a liquid catalyst to cure the mold or core, also known as cold-curing.

Riser—cavity connected to a mold or casting cavity of the casting assembly which acts as a reservoir for excess molten metal to prevent cavities in the casting as it contracts on solidification. Risers may be open or blind. Risers are also known as feeders or heads.

Sleeve—any moldable shape having exothermic and/or insulating properties made from a sleeve composition which covers, in whole or part, any component of the casting assembly such as the riser, runners, pouring cup, sprue, etc. or is used as part of the casting assembly. Sleeves can have a variety of shapes, e.g. cylinders, domes, cups, boards, cores.

DESCRIPTION OF BEST MODE AND OTHER MODES FOR PRACTICING THE INVENTION

The insulating properties of the sleeve are provided by hollow aluminosilicate microspheres. The sleeves made with aluminosilicate hollow microspheres have low densities, low thermal conductivities, and excellent insulating properties. Depending upon the degree of insulating properties wanted in the sleeve, the amount of hollow aluminosilicate microspheres, in the sleeve will range from 65 weight percent to 98 weight percent, typically 80 weight percent to 90 weight percent, based upon the weight of the sleeve composition.

The hollow aluminosilicate microspheres typically have a particle size of about 200 to 300 microns with any wall thickness. It is believed that hollow microspheres made of material other than aluminosilicate, having insulating properties, can also be used to replace or used in combination with the hollow aluminosilicate microspheres. If hollow aluminosilicate microspheres are used, the weight percent of alumina to silica (as $SiO_2$) in the hollow aluminosilicate microspheres can vary over wide ranges depending on the application, for instance from 25:75 to 75:25, typically 33:67 to 50:50, where said weight percent is based upon the total weight of the hollow microspheres.

The inorganic binder is boric acid, phosphate glass, or mixtures. The inorganic binder is generally used in amounts of 1 weight percent to 15 weight percent, preferably 3 weight percent to 8 weight percent, where the weight percent is based upon the weight percent of the sleeve mix.

The organic binders that are mixed with the sleeve composition to form the sleeve mix are well known in the art. Any organic hot-box, no-bake, or cold-box binder, which will sufficiently hold the sleeve mix together in the shape of a sleeve. Examples of such binders are phenolic resins, phenolic urethane binders, furan binders, alkaline phenolic resole binders, and epoxy-acrylic binders among others. Particularly preferred are epoxy-acrylic and phenolic urethane binders known as EXACTCAST™ cold-box binders sold by Ashland Chemical Company. The phenolic urethane binders are described in U.S. Pat. Nos. 3,485,497 and 3,409,579, which are hereby incorporated into this disclosure by reference. These binders are based on a two part system, one part being a phenolic resin component and the other part being a polyisocyanate component. The epoxy-acrylic binders cured with sulfur dioxide in the presence of an oxidizing agent are described in U.S. Pat. No. 4,526,219 which is hereby incorporated into this disclosure by reference.

The amount of binder needed is an effective amount to maintain the shape of the sleeve and allow for effective curing, i.e. which will produce a sleeve which can be handled or self-supported after curing. An effective amount of binder is greater than about 4 weight percent, based upon the weight of the sleeve composition. Preferably the amount of binder ranges from about 5 weight percent to about 15 weight percent, more preferably from about 6 weight percent to about 12 weight percent.

Curing the sleeve by the no-bake process takes place by mixing a liquid curing catalyst with the sleeve mix (alternatively by mixing the liquid curing catalyst with the sleeve composition first), shaping the sleeve mix containing the catalyst, and allowing the sleeve shape to cure, typically at ambient temperature without the addition of heat. The preferred liquid curing catalyst is a tertiary amine and the preferred no-bake curing process is described in U.S. Pat. No. 3,485,797 which is hereby incorporated by reference into this disclosure. Specific examples of such liquid curing catalysts include 4-alkyl pyridines wherein the alkyl group has from one to four carbon atoms, isoquinoline, arylpyridines such as phenyl pyridine, pyridine, acridine, 2-methoxypyridine, pyridazine, 3-chloro pyridine, quinoline, N-methyl imidazole, N-ethyl imidazole, 4,4'-dipyridine, 4-phenylpropylpyridine, 1-methylbenzimidazole, and 1,4-thiazine.

Curing the sleeve by the cold-box process takes place by blowing or ramming the sleeve mix into a pattern and contacting the sleeve with a vaporous or gaseous catalyst. Various vapor or vapor/gas mixtures or gases such as tertiary amines, carbon dioxide, methyl formate, and sulfur dioxide can be used depending on the chemical binder chosen. Those skilled in the art will know which gaseous curing agent is appropriate for the binder used. For example, an amine vapor/gas mixture is used with phenolic-urethane resins. Sulfur dioxide (in conjunction with an oxidizing agent) is used with an epoxy-acrylic resins. See U.S. Pat. No. 4,526,219 which is hereby incorporated into this disclosure by reference.

Carbon dioxide (see U.S. Pat. No. 4,985,489 which is hereby incorporated into this disclosure by reference) or methyl esters (see U.S. Pat. No. 4,750,716 which is hereby incorporated into this disclosure by reference) are used with alkaline phenolic resole resins. Carbon dioxide is also used with binders based on silicates. See U.S. Pat. No. 4,391,642 which is hereby incorporated into this disclosure by reference.

Preferably the binder is an EXACTCAST™ cold-box phenolic urethane binder cured by passing a tertiary amine gas, such a triethylamine, through the molded sleeve mix in the manner as described in U.S. Pat. No. 3,409,579, or the epoxy-acrylic binder cured with sulfur dioxide in the presence of an oxidizing agent as described in U.S. Pat. No. 4,526,219. Typical gassing times are from 0.5 to 3.0 seconds, preferably from 0.5 to 2.0 seconds. Purge times are from 1.0 to 60 seconds, preferably from 1.0 to 10 seconds.

The sleeve mix may contain optional components such as sodium silicate, fillers, and refractories. Refractories are used in the insulating sleeve composition to impart a higher melting point to the sleeve mixture so the sleeve will not degrade when it comes into contact with the molten metal during the casting process. Examples of such refractories include silica, magnesia, alumina, olivine, chromite, aluminosilicate, and silicon carbide among others. These refractories are preferably used in amounts less than 50 weight percent based upon the weight of the sleeve composition, more preferably less than 25 weight percent based upon the weight of the sleeve composition.

EXAMPLES

In all of the examples which follow, the binder used was the EXACTCAST phenolic-urethane binder as specified where the ratio of Part I to Part II was 55/45. The insulating sleeve mixes were prepared by mixing one hundred parts of hollow aluminosilicate microspheres[1], the inorganic binder, and 8.8% of EXACTCAST™ binder to form an insulating sleeve mix. The sleeve mix was mixed in a Hobart N-50 mixer for about 2–4 minutes. The mix was injected into a sleeve pattern. The insulating sleeve mix is blown into a pattern having the shape of an insertable sleeve and gassed with triethylamine in nitrogen at 20 psi according to known methods described in U.S. Pat. No. 3,409,579. Gas time is 1 second, followed by purging with air at 40 psi for about 30 seconds. The sleeves prepared were insertable sleeves 60 mm in internal diameter, 80 mm in external diameter, and 100 mm in height.

[1]The hollow aluminosilicate microspheres

The tensile strengths of the cured sleeves are measured immediately and 24 hours after removing them from the corebox. Hot tensile strengths were also measured after baking the test sleeves in an oven at 700° C. for 6 minutes to simulate casting conditions. The amounts of the inorganic binder and the tensile strengths of the sleeves are set forth in Table I. The sleeves are dimensionally accurate, both externally and internally.

All lettered examples are controls and do not contain an inorganic binder in the insulating sleeve composition. All parts are by weight and all percentages are weight percentages based upon the weight of the sleeve composition unless otherwise specified. The following abbreviations were used in Table I:

TABLE I

IMM = immediate.
BA = boric acid.
PG = phosphate glass.
SS = sodium silicate.
TS = tensile strength.

(Tensile Strengths of Insulating Sleeves)

| Example | Inorganic Binder | % Inorganic Binder | IMM TS | 24 Hour TS | TS after 6 min. @ 700 C |
|---|---|---|---|---|---|
| A | 0 | 0 | 96 | 134 | 0 |
| 1 | BA | 3 | 81 | 171 | 43 |
| 2 | BA | 5 | 67 | 147 | 63 |
| 3 | BA | 7 | 54 | 166 | 109 |
| 4 | PG | 3 | 148 | 168 | 7 |
| 5 | PG | 5 | 145 | 174 | 8 |
| 6 | BA/SS | 5.0/0.5 | 77 | 142 | 73 |

Table I shows that the immediate and 24 hour tensile strengths of sleeves made from a mix containing boric acid and phosphate glass are adequate for use conditions, and can be improved if a small amount of sodium silicate is added to the sleeve mix (Example 6). However, the addition of the inorganic binder improves hot strength which is needed when the organic binder degrades at casting temperatures. Although hot strengths are lower than cold strengths, they are adequate for the reuse of the insulating sleeve, and desirable because they allow for better shakeout if the sleeve is not to be reused.

Aluminum test castings were made using insertable sleeves measuring 2.5"×3.75". Castings were made by pouring molten aluminum 319 (an aluminum alloy that has a wide freezing range) having a temperature of about 730° C., into an insertable style riser sleeve that was placed upside down. The upside down insertable riser sleeve created a cup that could be filled with molten metal. The sleeves did not degrade when exposed to the molten metal and could be reused. The sleeves without the inorganic additive broke within a few seconds after pouring and did not hold the metal until solidification was complete.

We claim:

1. An insulating sleeve mix comprising:

A. a major amount of an insulating refractory material comprising hollow aluminosilicate microspheres;

B. a chemically reactive organic binder in amount of at least 5 weight percent based upon the weight of (A); and C. a hot strength enhancing amount of a secondary inorganic binder selected from the group consisting of boric acid, phosphate glass, and mixtures thereof.

2. The insulating sleeve mix of claim 1 wherein the inorganic binder is boric acid.

3. The insulating sleeve mix of claim 2 wherein the amount of boric acid is from 3 weight percent to 10 weight percent based upon the weight of the sleeve mix.

4. An insulating sleeve prepared by the steps comprising:

(A) introducing the insulating sleeve mix of claim 1, 2, or 3 into a sleeve pattern to prepare an uncured sleeve;

(B) contacting said uncured sleeve prepared by (A) with a curing catalyst;

(C) allowing said sleeve resulting from (B) to cure until said sleeve becomes handleable; and (D) removing said sleeve from the pattern.

5. The sleeve of claim 4 wherein the organic binder is selected from the group consisting of phenolic urethane binders and epoxy-acrylic binders.

6. The sleeve of claim 5 wherein the binder level is from about 4 weight percent to about 12 weight percent based upon the weight of the sleeve composition.

7. The sleeve of claim 6 wherein the amount of hollow aluminosilicate microspheres in the sleeve composition is from 60 weight percent to 95 weight percent based upon the weight of the sleeve composition.

8. The sleeve of claim 7 wherein the chemical binder is a phenolic urethane binder and the curing catalyst is a vaporous tertiary amine.

9. The sleeve of claim 7 wherein the chemical binder is an epoxy-acrylic binder and the curing catalyst is sulfur dioxide.

10. The sleeve of claim 7 wherein the chemical binder is a phenolic urethane binder and the curing catalyst is a liquid tertiary amine catalyst.

11. A process for casting a metal part which comprises:

(1) inserting an insulating sleeve of claim 4 into a casting assembly having a mold assembly where the thermal conductivity of said mold assembly is higher than the thermoconductivity of said sleeve;

(2) pouring metal, while in the liquid state, into said casting assembly;

(3) allowing said metal to cool and solidify; and (4) then separating the cast metal part from the casting assembly.

* * * * *